US008690586B2

(12) United States Patent
Schneider

(10) Patent No.: US 8,690,586 B2
(45) Date of Patent: Apr. 8, 2014

(54) INTER-BOARD CONNECTION SYSTEM WITH COMPLIANT FLEXIBLE PIN DEFORMATION PREVENTION

(75) Inventor: Richard Schneider, Livonia, MI (US)

(73) Assignee: Interplex Industries, Inc., College Point, NY (US)

( * ) Notice: Subject to any disclaimer, the term of this patent is extended or adjusted under 35 U.S.C. 154(b) by 50 days.

(21) Appl. No.: 13/474,059

(22) Filed: May 17, 2012

(65) Prior Publication Data

US 2012/0295490 A1 Nov. 22, 2012

Related U.S. Application Data

(60) Provisional application No. 61/486,977, filed on May 17, 2011.

(51) Int. Cl.
*H01R 12/00* (2006.01)

(52) U.S. Cl.
USPC ..... 439/66

(58) Field of Classification Search
USPC ..... 439/66, 69, 709, 474, 71, 482; 324/755, 324/765
See application file for complete search history.

(56) References Cited

U.S. PATENT DOCUMENTS

| | | | | | |
|---|---|---|---|---|---|
| 4,963,822 | A * | 10/1990 | Prokopp | 324/754.12 |
| 5,683,256 | A * | 11/1997 | Werther | 439/69 |
| 5,919,050 | A * | 7/1999 | Kehley et al. | 439/71 |
| 6,278,284 | B1 * | 8/2001 | Mori et al. | 324/756.02 |
| 6,719,573 | B2 * | 4/2004 | Koehler et al. | 439/79 |
| 6,869,289 | B2 * | 3/2005 | Sabatier et al. | 439/66 |
| 6,997,727 | B1 * | 2/2006 | Legrady et al. | 439/246 |
| 7,108,567 | B1 | 9/2006 | Korsunsky et al. | |
| 7,172,431 | B2 * | 2/2007 | Beaman et al. | 439/66 |
| 7,867,016 | B2 * | 1/2011 | Nabilek et al. | 439/474 |

FOREIGN PATENT DOCUMENTS

| | | |
|---|---|---|
| JP | 11-233216 | 8/1999 |
| KR | 10-2009-0047352 | 5/2009 |

* cited by examiner

*Primary Examiner* — Alexander Gilman
(74) *Attorney, Agent, or Firm* — Preti Flaherty Beliveau & Pachios LLP

(57) ABSTRACT

An assembly for preventing deformation of compliant pins when interconnecting two printed circuit boards with the pins includes a mechanism for limiting an amount of movement of a flexible portion of the pins. In one approach, a bar is placed within the flexible portion of the pins to block damaging movement. In another approach, wing portions of the pins are locked into a surface thus preventing movement of the pin that could cause damage to the flexible portion of the pin.

25 Claims, 15 Drawing Sheets

INTER-BOARD CONNECTION SYSTEM WITH COMPLIANT FLEXIBLE PIN DEFORMATION PREVENTION

CROSS REFERENCE TO RELATED APPLICATIONS

This application claims the benefit under 35 U.S.C. §119 (e) of U.S. Provisional Patent Application Ser. No. 61/486,977 entitled "Compliant Terminal," filed on May 17, 2011, the contents of which are incorporated by reference in their entirety for all purposes.

BACKGROUND OF THE INVENTION

In many systems it may be necessary to couple one printed circuit board (PCB) to another in order for components on each PCB to communicate with one another. Often, one PCB is stacked upon the other with a plurality of compliant pins extending from the lower board into the upper board to facilitate the electrical connection. A stiff or sturdy pin is generally not used because of the effects of any mismatch between the coefficient of thermal expansion (CTE) of one PCB with respect to the other PCB.

During assembly, however, it is known that it is possible that the pins could be damaged if excessive force is used when seating the upper PCB. To prevent damage to the pins during assembly, some propose to build a stop directly into the design of the pin. The stop within the pin, however, can still translate damaging force directly to the lower PCB. This is especially problematic when the lower PCB is a ceramic direct bonded copper (DBC) style board.

A mechanism for preventing damage to the pins is needed.

BRIEF SUMMARY OF THE INVENTION

In one embodiment, a compliant terminal assembly interconnects first and second printed circuit boards. The assembly includes a stop member having a first predetermined dimension and a compliant terminal. The terminal includes a first terminal end for electrical connection to a first circuit board, a second terminal end for electrical connection to a second circuit board and a compliant portion. In one embodiment, the compliant portion is U-shaped and the stop member is disposed between the legs of the of the U-shaped compliant portion.

In another embodiment, a connection system comprises a first substrate and a plurality of compliant pins disposed in a first arrangement on the first substrate with each compliant pin comprising at least one wing. A housing frame is disposed on the first substrate and a stop comb is disposed in the housing frame. The stop comb has a plurality of comb openings arranged and sized to capture at least one wing of a corresponding compliant pin.

BRIEF DESCRIPTION OF THE SEVERAL VIEWS OF THE DRAWINGS

The above and further advantages of the present invention may be better understood by referring to the following description in conjunction with the accompanying drawings in which.

Figure 1:
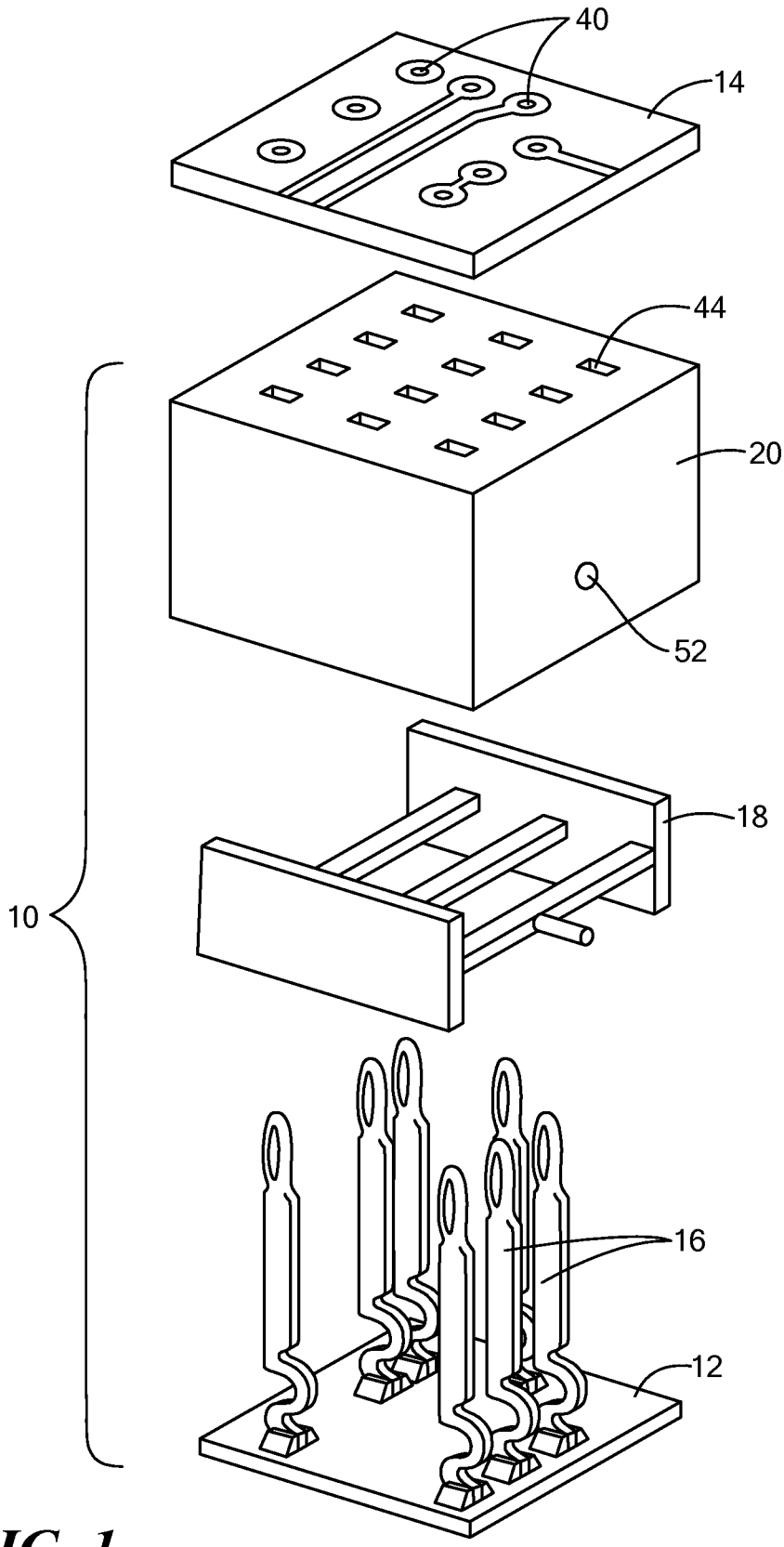
FIG. 1 is an exploded view of an embodiment of the present invention.

It will be appreciated that for simplicity and clarity of illustration, elements shown in the drawings have not necessarily been drawn accurately or to scale. For example, the dimensions of some of the elements may be exaggerated relative to other elements for clarity or several physical components may be included in one functional block or element. Further, where considered appropriate, reference numerals may be repeated among the drawings to indicate corresponding or analogous elements. Moreover, some of the blocks depicted in the drawings may be combined into a single function.

DETAILED DESCRIPTION OF THE INVENTION

The contents of U.S. Provisional Patent Application Ser. No. 61/486,977 entitled "Compliant Terminal," filed on May 17, 2011, are incorporated herein by reference in their entirety for all purposes.

In the following detailed description, numerous specific details are set forth in order to provide a thorough understanding of embodiments of the present invention. It will be understood by those of ordinary skill in the art that these embodiments may be practiced without these specific details. Further, known methods, procedures, components and structures may not have been described in detail so as not to obscure the present invention.

Prior to explaining at least one embodiment of the present invention in detail, it is to be understood that the invention is not limited in its application to the details of construction and the arrangement of the components set forth in this description or illustrated in the drawings. The invention is capable of other embodiments or of being practiced or carried out in various ways. Also, it is to be understood that the phraseology and terminology employed herein are for the purposes of description and explanation and should not be regarded as limiting.

As will be described below, referring to FIG. 1, an exploded view of one embodiment of the present invention is a compliant terminal assembly 10 for making electrical interconnections between two substrates, for example, a first printed circuit board (PCB) 12 and a second printed circuit board 14. The first printed circuit board 12 may be a direct bonded copper (DBC) substrate or any other type of printed circuit card in a system that needs to have electrical interconnections made to the second opposed printed circuit board 14. The compliant terminal assembly 10 includes a plurality of compliant pins 16, a stop member 18, and a case or housing 20.

Figure 2:
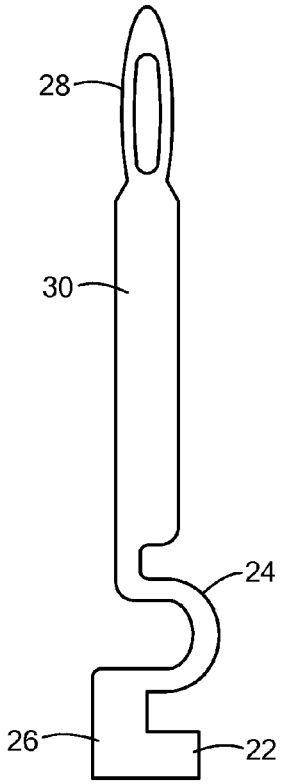
FIG. 2 is a side-view of a compliant pin used in an embodiment of the present invention.

Referring to FIG. 2, each compliant pin 16 includes a first terminal end 22, a flexible or compliant portion 24, a first coupling portion 26 coupling the first terminal end 22 to the compliant portion 24, a second terminal end 28 and a second coupling portion 30 coupling the compliant portion 24 to the second terminal end 28. In one embodiment, the second terminal end 28 is a press-fit solderless interconnect portion that is inserted through a corresponding plated through hole 40 in the second printed circuit board 14 and sized for a friction or interference fit within the corresponding plated through hole 40. After being inserted through the plated through hole in the second printed circuit board 14, the second terminal ends 28 may optionally be soldered therein. The compliant pins 16 are formed as a unitary piece of an electrically conductive material by known metal stamping or forming techniques.

The first terminal end 22 may be configured for a soldered surface mount connection, such as a surface mount connection to a DBC substrate as illustrated in FIG. 1. Alternatively, the first terminal end 22 may be configured as a through-hole terminal for insertion through a plated-through hole in the first printed circuit board 12 (not illustrated).

In one embodiment, the compliant portion 24 is a flexible portion which is generally U-shaped. It should be recognized that the compliant portion can be S-shaped, coiled or any suitable shape that provides a compliant flexible structure to accommodate movements, e.g., along the length of the pin 16, between the opposed printed circuit boards or substrates 12, 14 due to, for example, differences in the coefficient of thermal expansion (CTE) of the interconnected printed circuit boards.

The interconnection of the first and second printed circuit boards 12, 14 using the compliant terminal assembly 10 will now be described, with respect to FIG. 1. The first terminal end 22 of each compliant pin 16 is affixed to the first printed circuit board 12. The pins 16 are either soldered, if the first terminal end 22 is a surface mount connection or inserted through a corresponding plated through hole 40 (not illustrated) if the first terminal end 22 is a through-hole terminal similar to the second terminal end 28. The stop member 18 and case 20 are then arranged over the plurality of pins 16. The case has a plurality of openings 44 sized and arranged to accept a corresponding pin 16. The stop member 18 can either be part of the case 20 or sized to fit within it. The stop member 18, as will be discussed below, is arranged to slide within the flexible portion 24 of the pins 16.

Figure 3A:
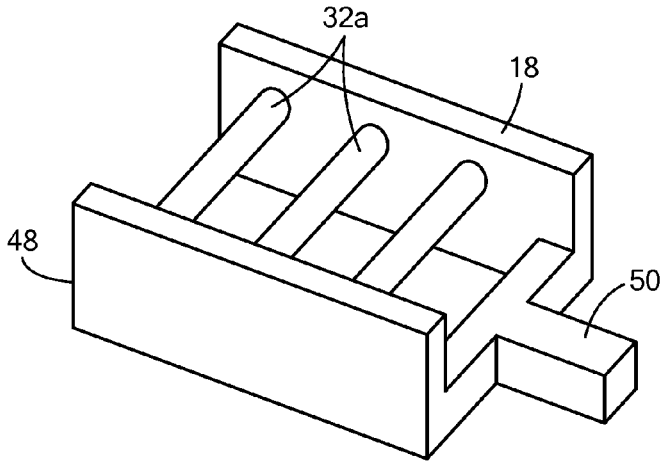
FIGS. 3A and 3B are views of a stop member.
Figure 3B:
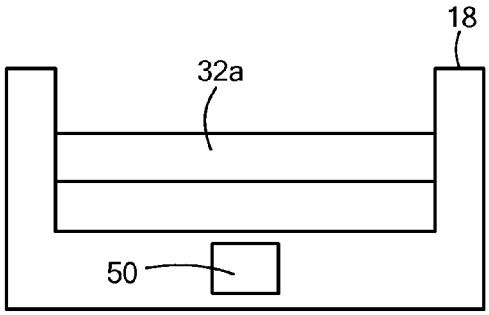
Figure 4:
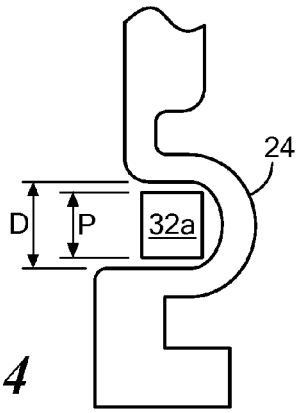
FIG. 4 is a side view of a portion of the stop member of FIGS. 3A and 3B arranged within a portion of the compliant pin of FIG. 2.

Referring now to FIGS. 3A and 3B, the stop member 18 includes a frame 48 with stop portions 32*a* arranged across the frame 48. An indicator extension 50, as will be discussed below, is also provided on the frame 48. The stop portions 32*a* will be disposed within the compliant portions 24, i.e., between the legs of the U-shaped compliant portions 24, of the compliant pins 16. The stop portions 32*a* are sized so as to have a height P that is slightly less then a distance D between the inside edges of opposed legs of the U-shaped compliant portion 24 when the compliant portion 24 is in its normal undeformed state as shown in FIG. 4. While shown as having a square or rectangular cross-section, the stop portions 32*a* may have other cross-section shapes including circular or oval.

Figure 5:
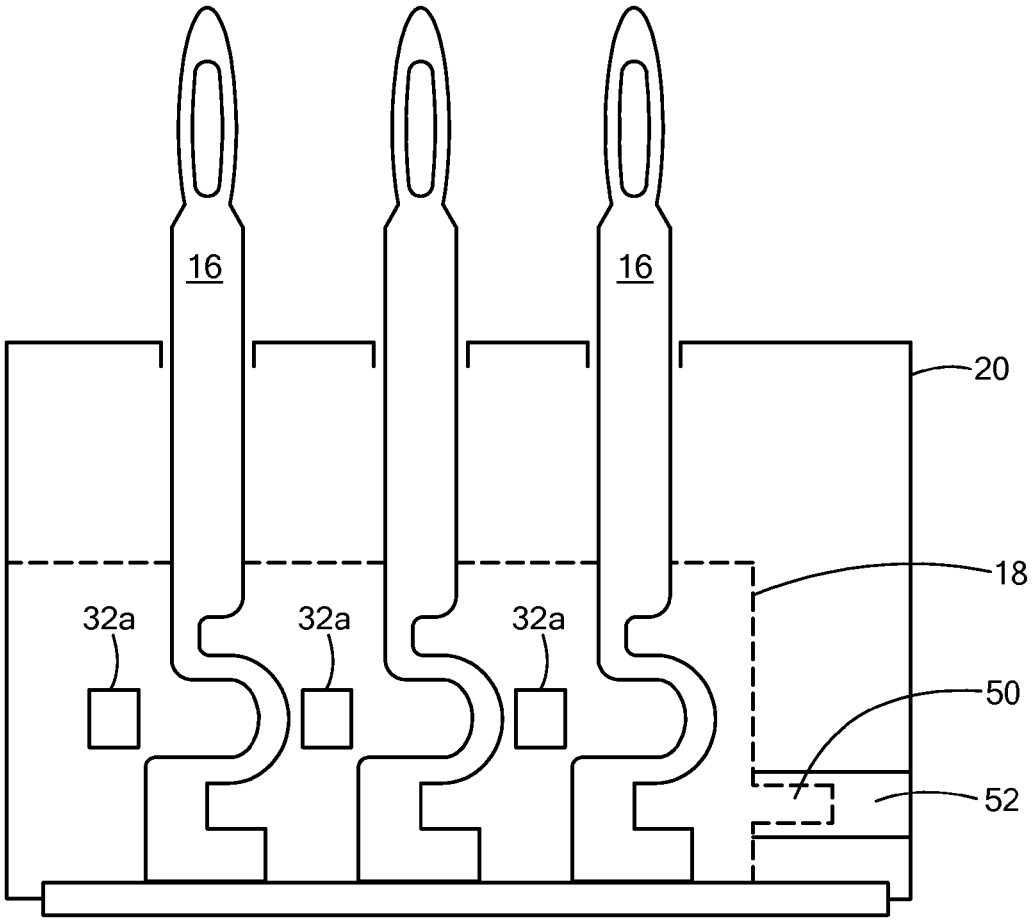
FIG. 5 is a side-view of an embodiment of the present invention in a first position.

Referring now to FIG. 5, a cutaway view, in a staged position, the stop member 18 is arranged such that the stop portions 32*a* are not within the compliant portions 24. The indicator portion 50 thus does not show through an indicator hole 52 in the case 20.

In operation, when the second PCB 14 is placed on the pins 16, there is a risk that too much force will be exerted on one or more of the pins 16 and the compliant portion 24 will become permanently deformed. If deformed, the compliant portion 24 may not be able to accommodate any changes in the distance between the first and second PCBs due to different CTEs potentially causing a connection failure.

Figure 6:
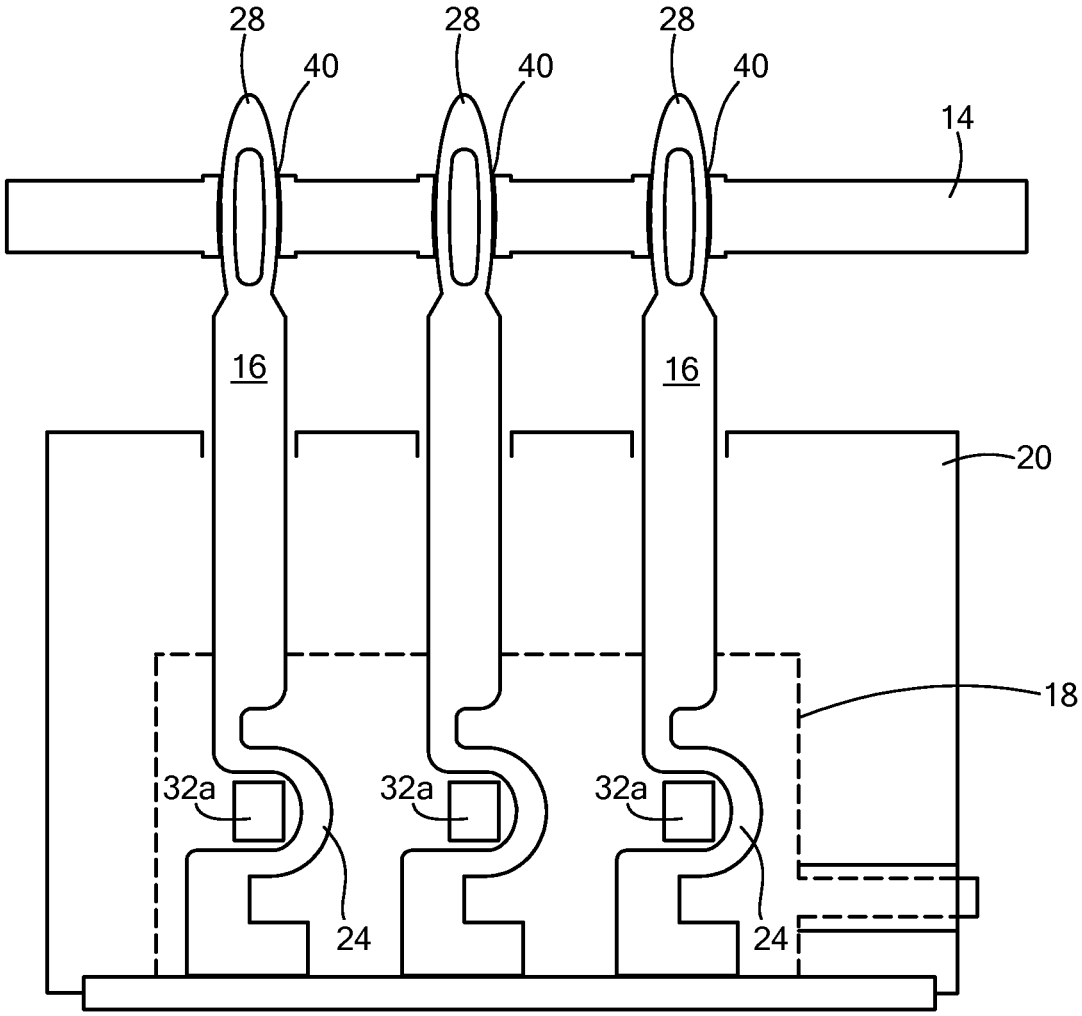
FIG. 6 is a side-view of an embodiment of the present invention in a second position.

In order to prevent permanent deformation of the pins 16, referring now to FIG. 6, the stop member 18 is re-positioned, i.e., placed in a final position, such that the stop portions 32*a* are within the compliant portions 24. Since the dimension D between the inside edges of opposed legs of the U-shaped compliant portion 24 is slightly greater than the height P of the stop portion 32*a*, the compliant portion 24 can deform in response to forces urging the opposing legs toward one another until the inside edges of the opposing legs abut opposite sides of the stop portion 32*a*. Thus, during assembly, a hard stop is provided by the stop portions 32*a* which limits the compression of the compliant portion 24 when the second printed circuit 14 is being assembled over the second terminal ends 28 of the compliant pins 16. There remains, however, sufficient room (D-P) for the compliant portion 24 to accommodate changes due to temperature increases and differing CTEs.

In order to confirm that the stop portion 32*a* is in position, prior to installing the second printed circuit board 14, the indicator hole 52 can be checked for evidence of the indicator portion 50 which may be of a different color than the case 20 to facilitate identification. Once there is confirmation that the portion 50 is showing in the hole 52, the second PCB may be placed.

The stop member 18 may be formed as an integral unit as a single piece as illustrated so that selected portions of the stop member 18 provide the stop portions 32*a* for the respective compliant portions 24. More specifically, the stop member 18 may be formed as a comb or grate as illustrated in FIG. 1 with the stop portions 32*a* formed as crossbars so that each crossbar 32*a* provides the stop portions that are disposed within a plurality of compliant portions 24 of corresponding compliant pins 16. Alternatively, the stop members 32 may be separable so that each stop portion 32*a* limits the travel of the compliant portion 24 of one or more of the compliant pins 16.

In the event an S-shaped compliant portion 24 is employed, multiple stop members 18 may be employed to limit the travel of the compliant portion when the compliant portion is in compression. More specifically, one stop member may be disposed in the upper section of the S-shaped compliant portion and another stop member may be disposed in the lower section of the S-shaped compliant portion. The stop members may be fabricated as a single piece or alternatively, they may be separate members. Similarly, one or more stop members may be employed where the compliant portion is a coiled structure and such stop members may be formed as a single piece or as separate members.

Figure 7A:
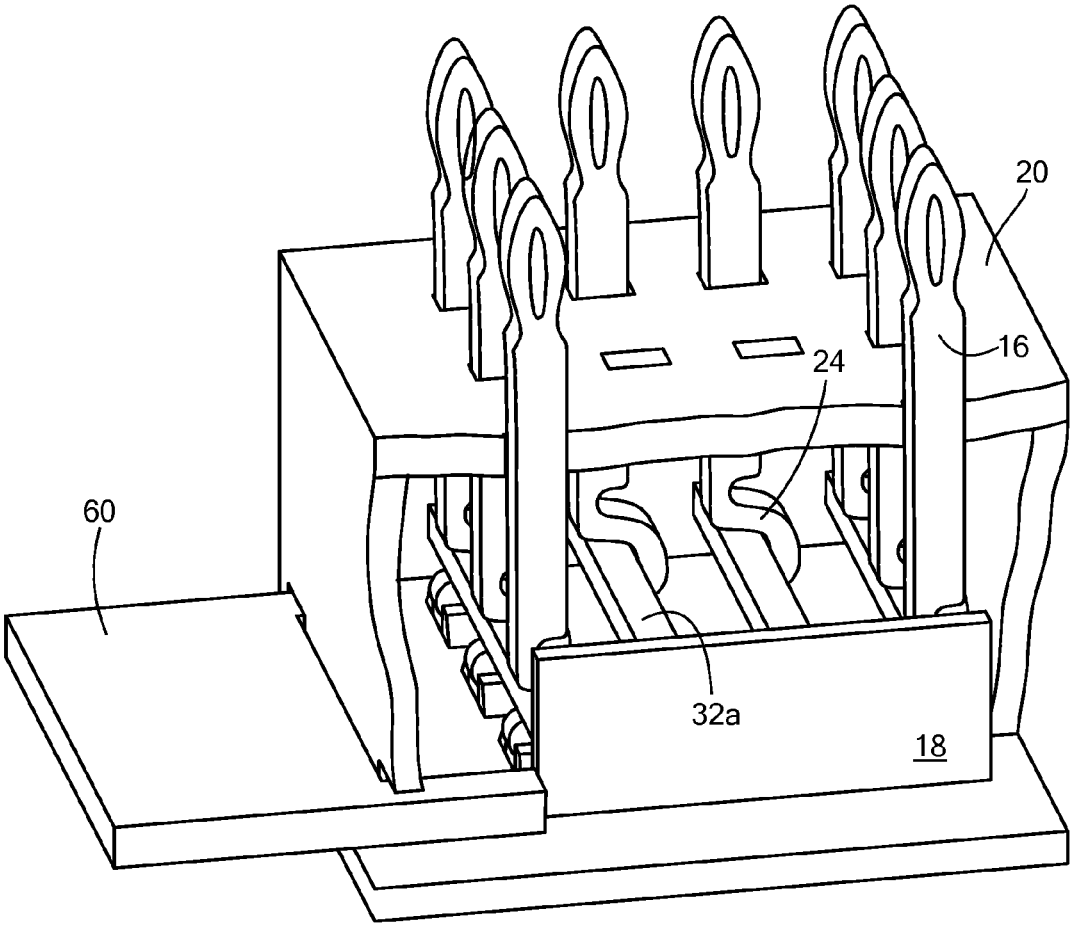
FIGS. 7A and 7B are perspective views of an embodiment of the present invention.
Figure 7B:
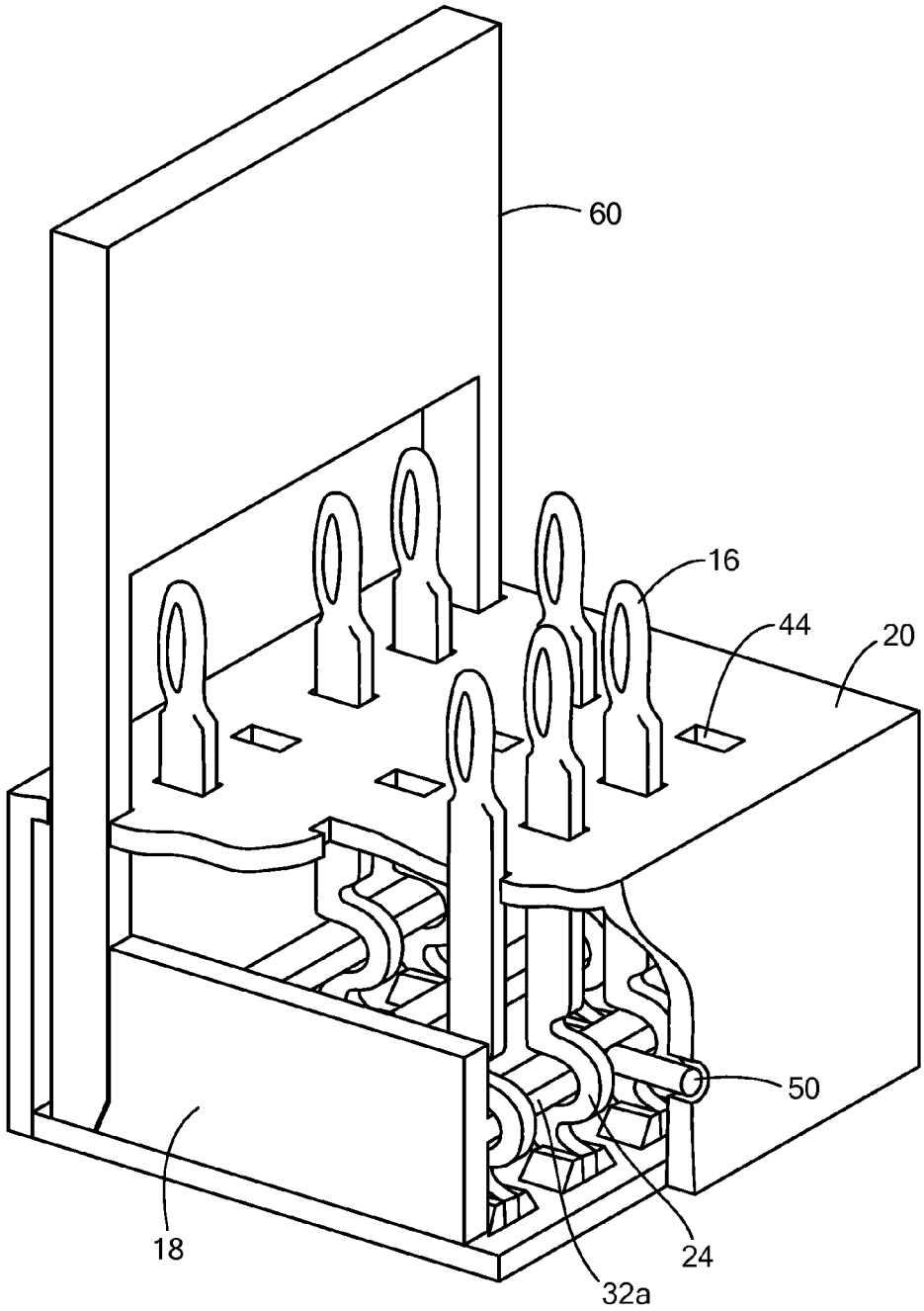

The stop member 18 may be movable between the staged position and the final position in response to operation of a tool 60 in either a horizontal implementation as shown in FIG. 7A or a vertical implementation, as shown in FIG. 7B, in conjunction with a suitable linkage such as, for example, a cammed or ramped surface on the stop member 18.

Figure 8:
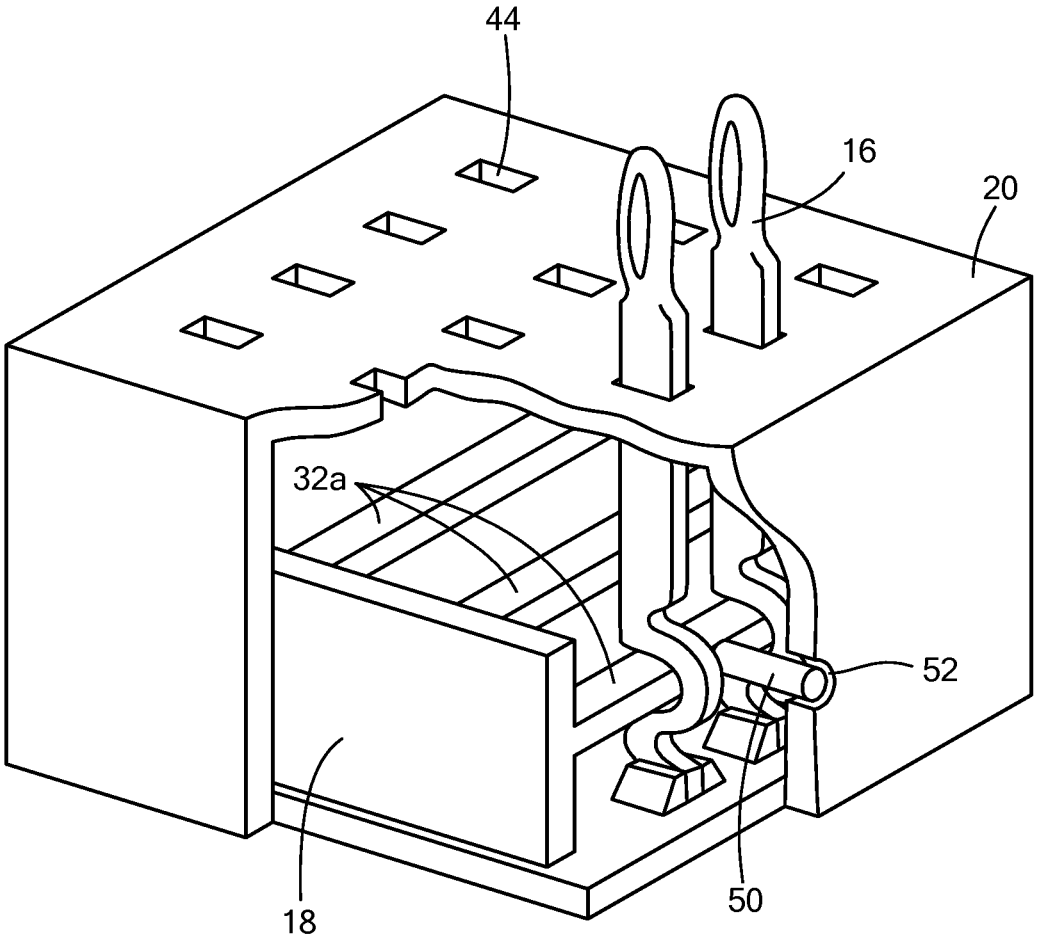
FIG. 8 is a perspective view of an embodiment of the present invention.
Figure 9:
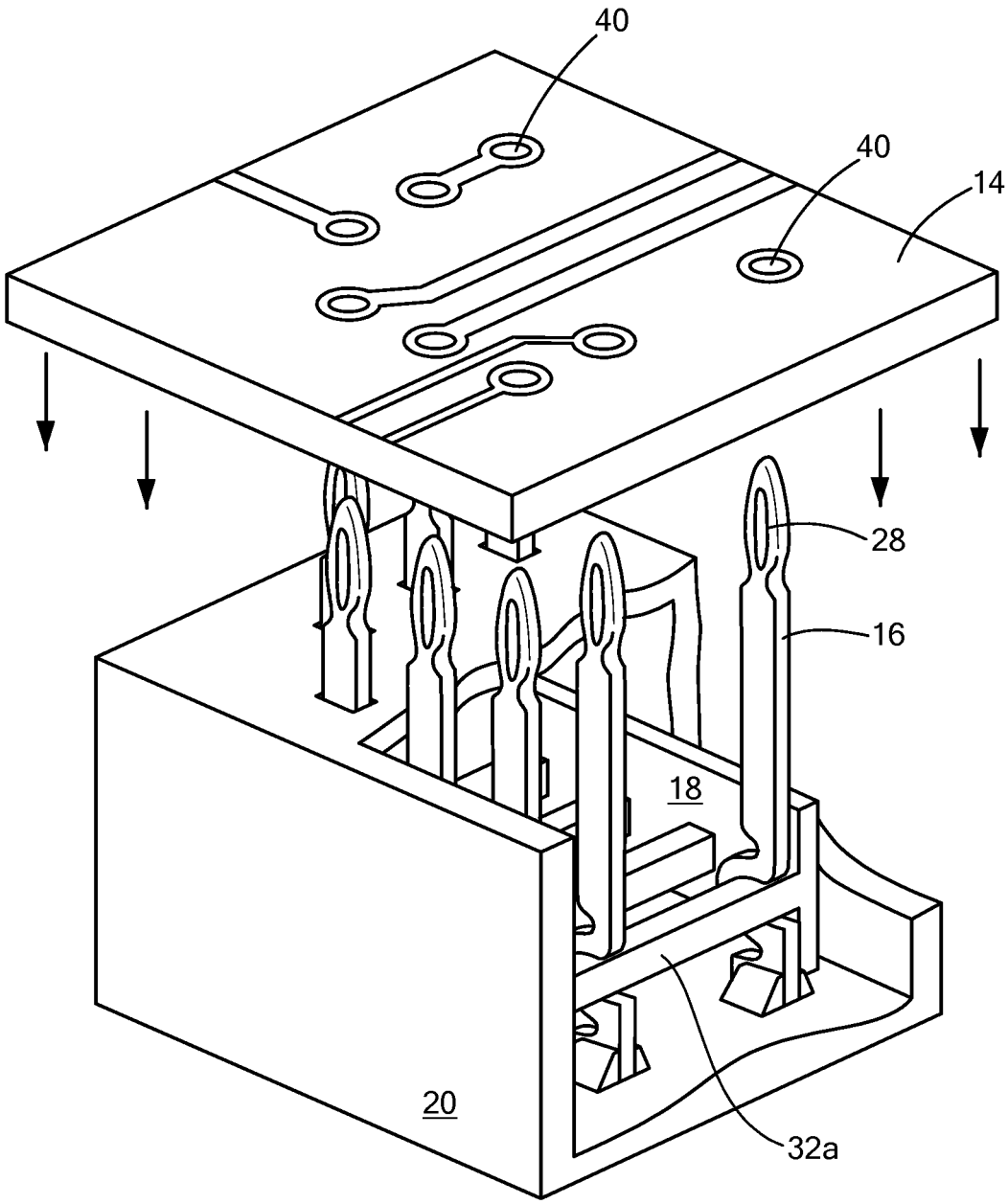
FIG. 9 is a perspective view of an embodiment of the present invention.

The interconnection of the first and second printed circuit boards 12, 14 using the compliant terminal assembly 10 is further illustrated in FIGS. 8 and 9.

The compliant pins 16 within the compliant terminal assembly 10 serve to absorb stresses that may result at the first and second terminal ends 22, 28 during assembly and over time due to temperature cycling of the electrical apparatus or mechanical stresses otherwise induced in the assembly. Furthermore, when the second printed circuit board 14 is installed on the second terminal ends 28 of the compliant pins 16, substantial downward forces may be exerted on the compliant pins 16 and the compliant portion 24 deforms until the spacing between the opposed legs of the compliant portion 24 is equal to the height P of the stop portion 32*a* disposed therein. Following assembly, the compliant portion 24 of the compliant pins 16 will still operate to absorb mechanical stresses within the apparatus resulting from temperature cycling or due to other causes if the opposed legs of the compliant portion 24 are not fully compressed against the respective stop portion 32*a* 18.

To provide for more movement of the compliant portion 24 of the pins 16, the stop portion 32*a* may be moved back to the staged position after the second PCB 14 is placed on the pins. Thus, the range of motion of the compliant portion 24 will no longer be limited by the stop portion 32*a*. It should be noted that either of the stop member 18, the stop portion 32*a* and/or the case 20 could be configured so that they may be removed once the two boards are attached.

Figure 10C:
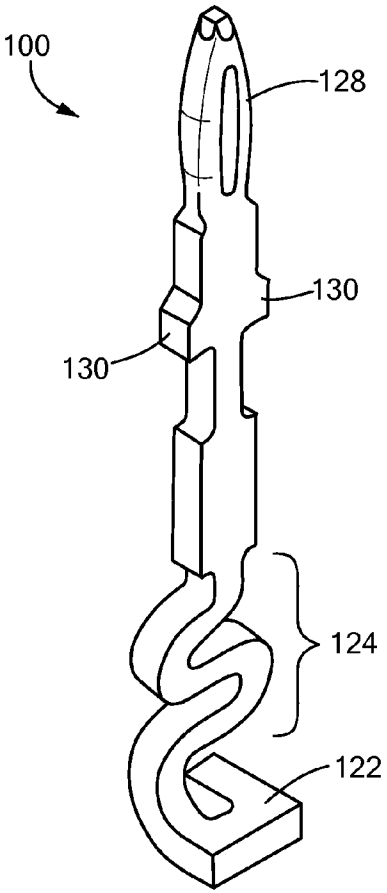
FIGS. 10A-10C are views of a compliant pin in accordance with an embodiment of the present invention.
Figure 10B:
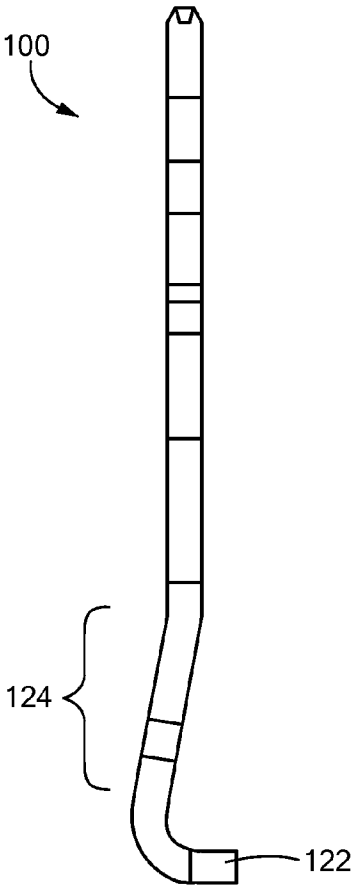
Figure 10A:
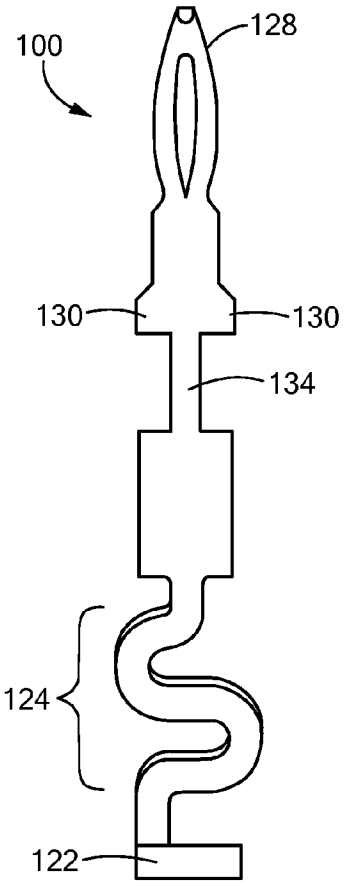

Another embodiment of the present invention also prevents damage to flexible interconnecting pins when a second PCB is attached. This embodiment uses a different pin 100, as shown in FIGS. 10A-10C. Each compliant pin 100 includes a first terminal end 122, a flexible or compliant portion 124 and a second terminal end 128. Two shoulders or wings 130 are located on the pin 100 and extend from a surface of the pin 100 adjacent a notch portion 134. In one embodiment, the second terminal end 128 is a press-fit solderless interconnect portion that is inserted through the corresponding plated through hole 40 in the second printed circuit board 14 and sized for a friction or interference fit within the corresponding plated through hole 40. After being inserted through the plated through hole in the second printed circuit board 14, the second terminal ends 128 may optionally be soldered therein. The compliant pins 100 are formed as a unitary piece of an electrically conductive material by known metal stamping or forming techniques.

The first terminal end 122 may be configured for a soldered surface mount connection. Alternatively, the first terminal end 122 may be configured as a through-hole terminal for insertion through a plated-through hole in the first printed circuit board 12 (not illustrated).

In one embodiment, the compliant portion 124 is a flexible portion which is generally S-shaped and which also provides for flexibility along the length of the pin 100 as well as normal to the length due to the bend as shown, from the side, in FIG. 10B, thus providing for X, Y, Z direction movement. It should be recognized that the compliant portion can be C-shaped, coiled or any suitable shape that provides a compliant flexible structure to accommodate movements between the opposed printed circuit boards or substrates 12, 14.

Figure 11:
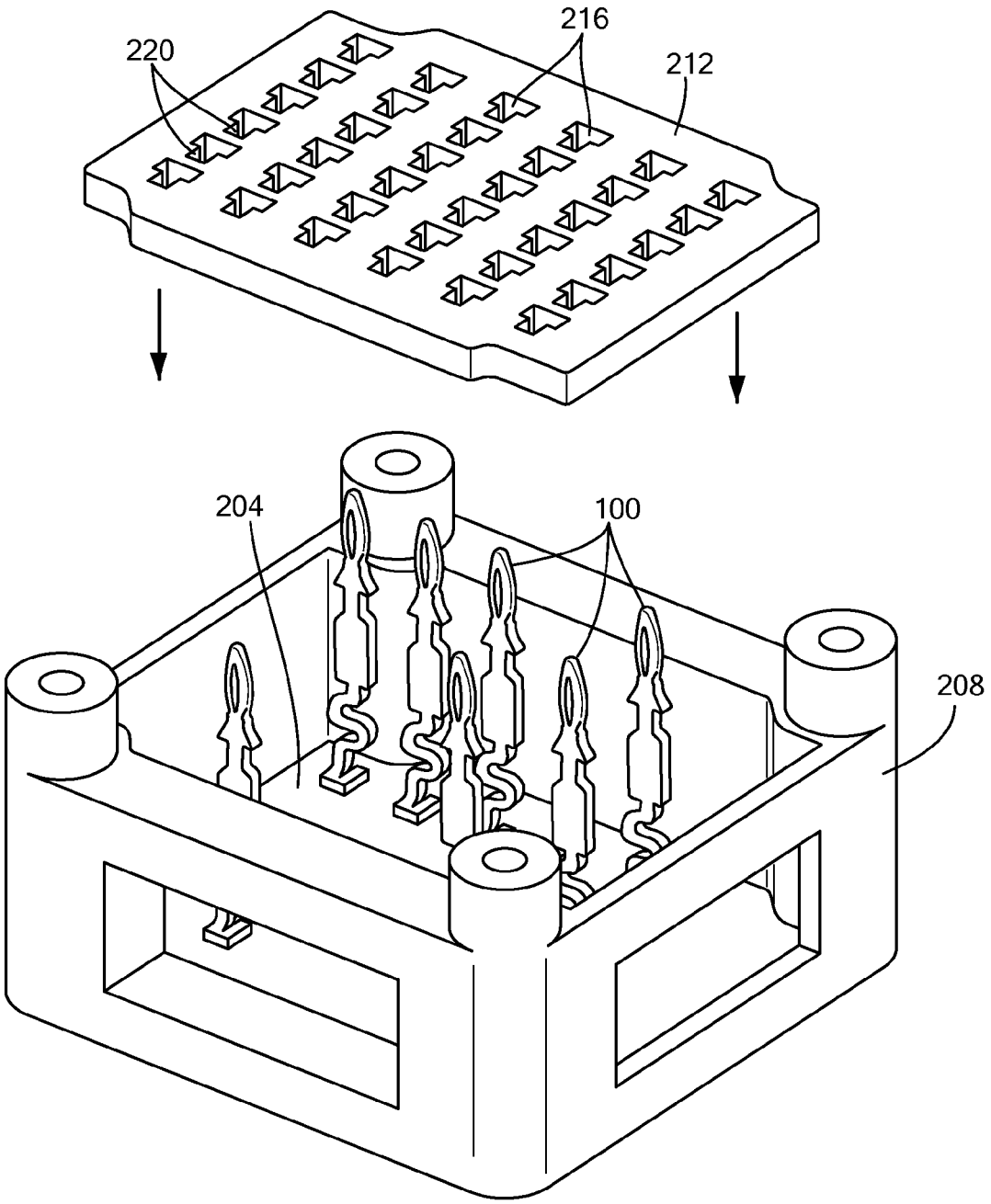
FIG. 11 is an exploded perspective view of an embodiment of the present invention.
Figure 12:
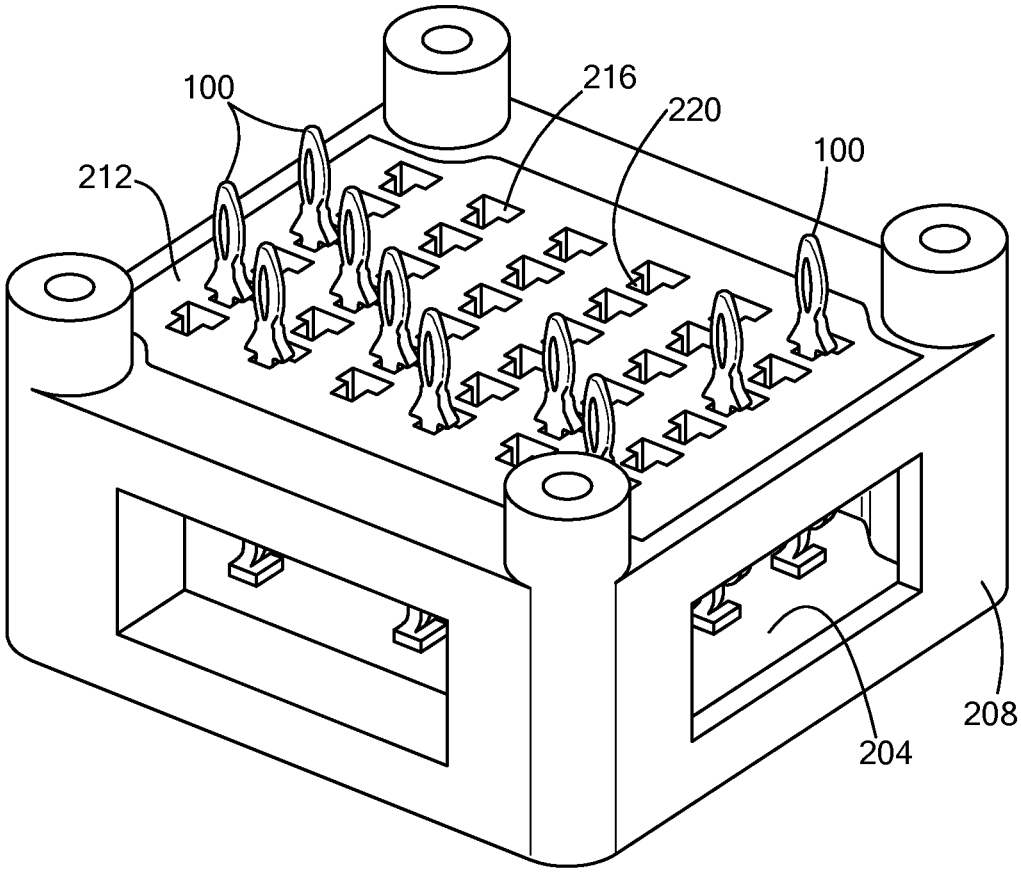
FIG. 12 is a perspective view of an embodiment of the present invention.

In operation, the pins 100 are attached to a first PCB 204, as shown in FIG. 11, and arranged as necessary for the particular application. A support frame/housing 208 is then provided around the plurality of pins 100. The support frame 208 includes a stop comb 212 having a plurality of comb openings 216 arranged with respect to the plurality of pins 100. Each comb opening 216 includes a key opening 220. The housing 208 and stop comb 212 are arranged such that, when in a first position, the second terminal ends 128 extend through the comb openings 216 as shown in FIG. 12.

Figure 13A:
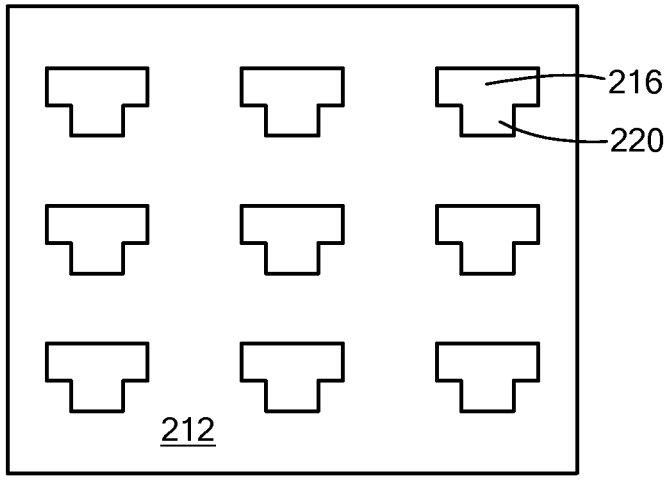
FIGS. 13A-13C are top views of the embodiment of the present invention show in FIGS. 11 and 12.
Figure 13B:
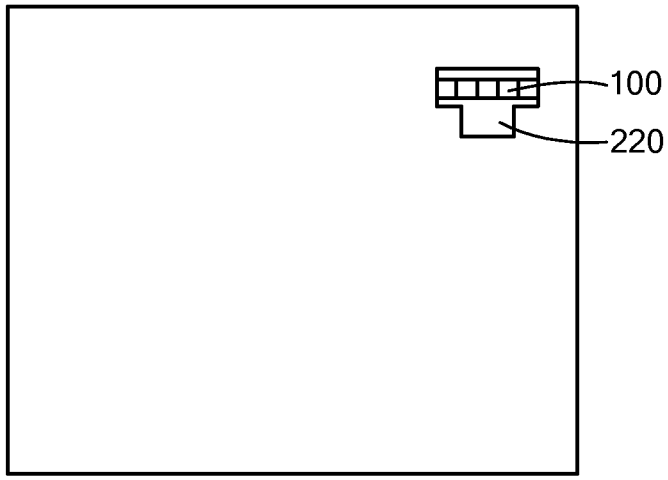
Figure 13C:
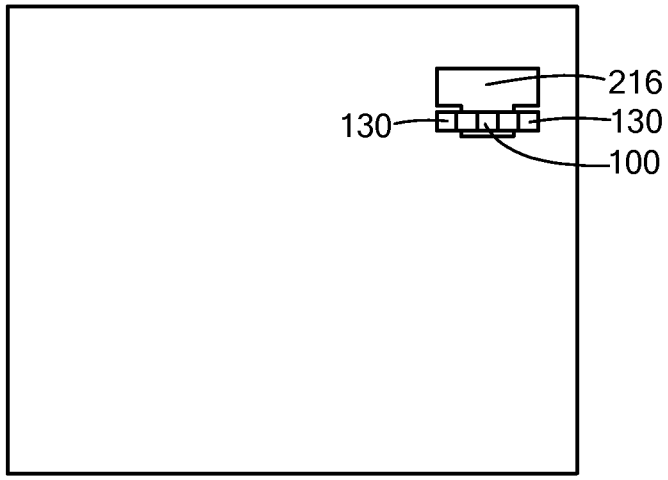
Figure 14:
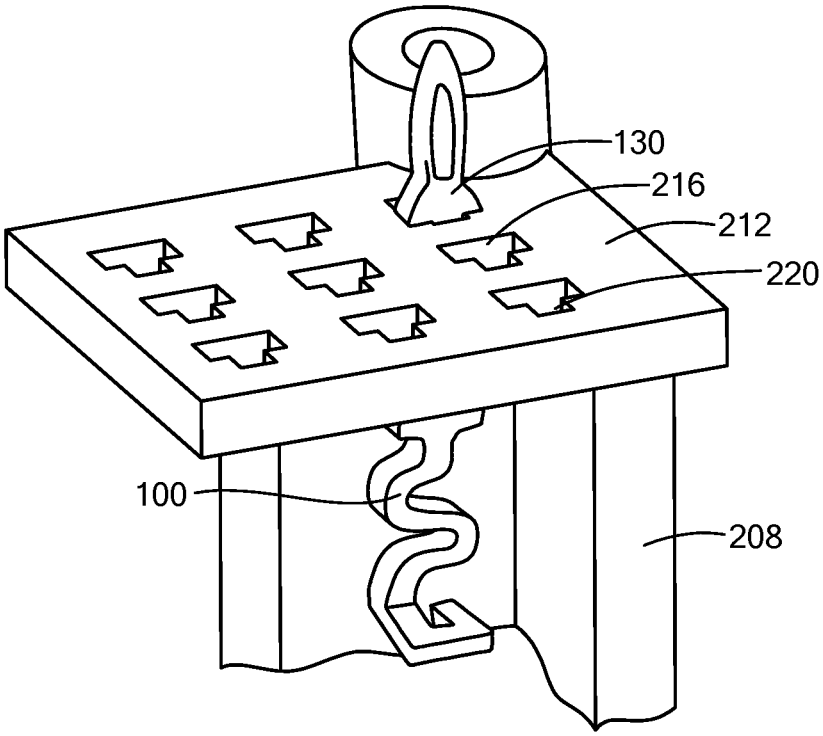
FIG. 14 is a perspective view of an embodiment of the present invention.
Figure 15:
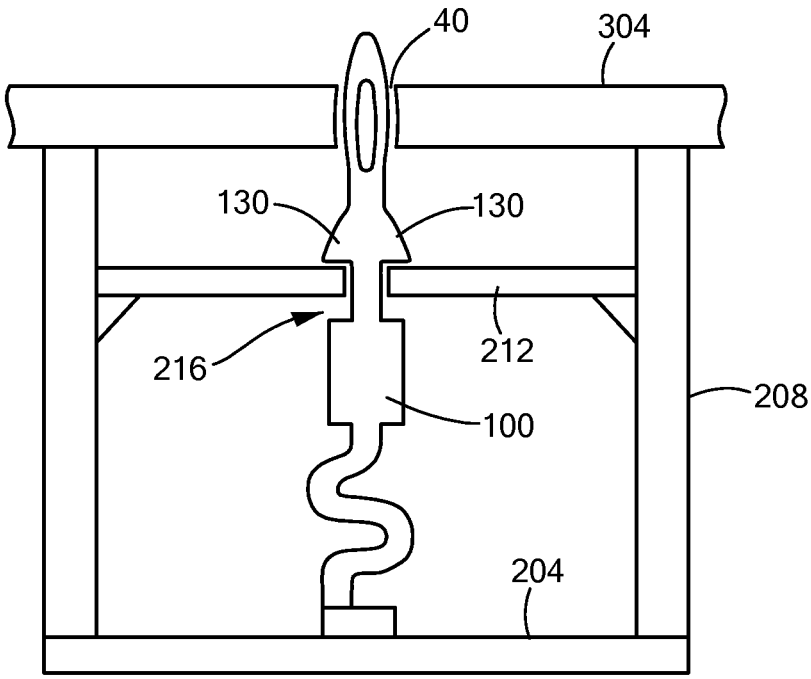
FIG. 15 is a side-view of the embodiment of the present invention shown in FIGS. 11-14.

Referring now to FIGS. 13A-13C, which are top views of the stop comb 212, one can see that the key opening 220 is smaller than the comb opening 216. The comb opening 216 is sized to allow the pin 100 to freely extend through the comb opening 216, as shown in FIG. 13B, in the first position. When the stop comb 212 is moved into a second position such that the notch portion 134 is inserted in the key opening 220, the wings 130 prevent the pin 100 from being pushed down. Once the pin 100 is locked in, as shown in FIGS. 14 and 15, a second PCB 304 can be attached to the pins 100 without concern that the compliant portions 124 of the pins 100 will be deformed due to too much force being exerted on them. One will understand that the notch portion 134 of the pin will have to be at least as large as a thickness of the stop comb 212 in order to allow for movement into the key opening 220. Advantageously, once assembled, the stress on the pins 100 is reduced by the housing 208 providing support for the second PCB.

Above, the stop comb 212 has been described as moveable with respect to the frame 208. Alternately, the stop comb 212 may be integral with the frame 208 and the frame 208 is then moved to place the wings 130 in the key opening 220 for subsequent placement of the top PCB. The frame 208 may be attached, for example, by screws or epoxy, to the first PCB to keep it in place. In the embodiments described herein, the second, or upper, PCB may either be attached or float upon pylons extending from the frame 208 or the case 20. Advantageously, a space is then provided to allow for air flow and better heat dissipation.

Similar to the first embodiment, the stop comb 212 may include a position indicator to aid in identifying which position the stop comb 212 is in. The stop comb 212 may also be configured to move within the frame 208 by vertical or horizontal manipulation.

As described above, the stop comb 212 remains in the locked position once the second PCB is put in place. In an alternate approach, the stop comb 212 may be moved back to the first position such that the wings 130 are no longer disposed in the key openings 220. This orientation allows for even more movement of the pin 100 with respect to the two boards.

Figure 16:
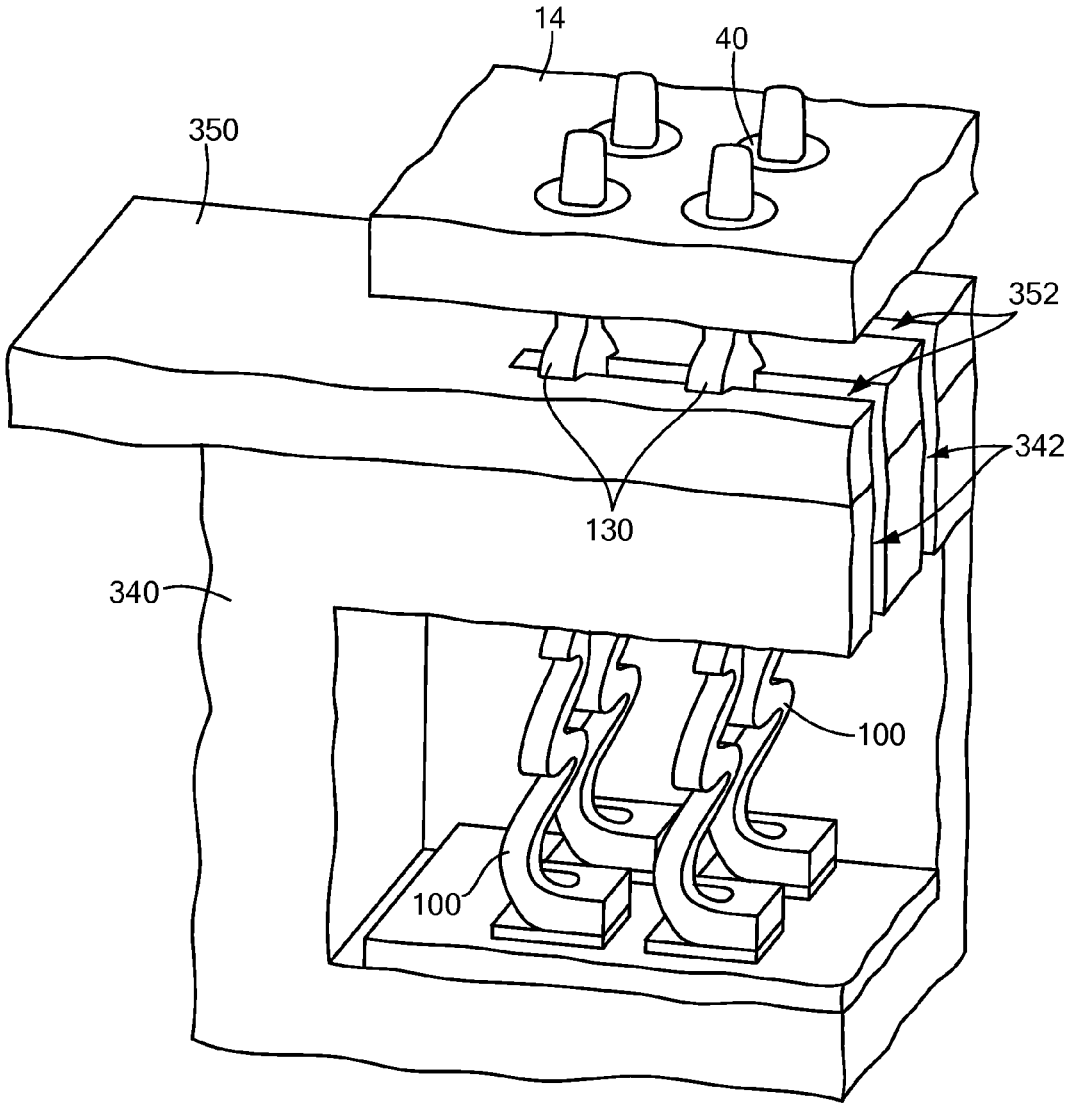
FIG. 16 is a perspective view of an embodiment of the present invention.

Alternatively, an embodiment of the present invention may be configured such that a stop comb could be removed once the second PCB is put in place. Referring now to FIG. 16, a frame 340 includes a plurality of slots 342 to allow the frame 340 to slide among the pins 100. A removable stop comb 350 has a plurality of stop slots 352 to catch the wings 130 of the pins 100. Once the second PCB 14 is put in place, the removable stop comb 350 may be slid out from under the wings 130. In addition, the frame 340 may also be removed if it is not otherwise being used to maintain the second PCB 14 in place.

In each of the embodiments, the pins may be made of a conductive material, for example, a Copper-based alloy, i.e., any red metal, such as a CuSn alloy or a phosphor bronze. Any non-conductive material, for example, a thermoplastic material, may be used for the frame, stop comb or any other portion that needs to be non-conductive. It should be noted that the materials listed here are exemplary only and not intended to be limiting.

Still further, a frame 208 with a fixed stop comb 212, i.e., a stop comb that does not move with respect to the frame 208, may be placed such that each comb opening 216 receives a corresponding pin 100. Once the frame 208 is in place, each pin 100 may be moved such that at least one wing 130 engages the stop comb 212. For example, each pin 100 may be moved to engage with the key opening 220. The pin 100 is sufficiently flexible to remain in this position without being damaged.

Figure 17:
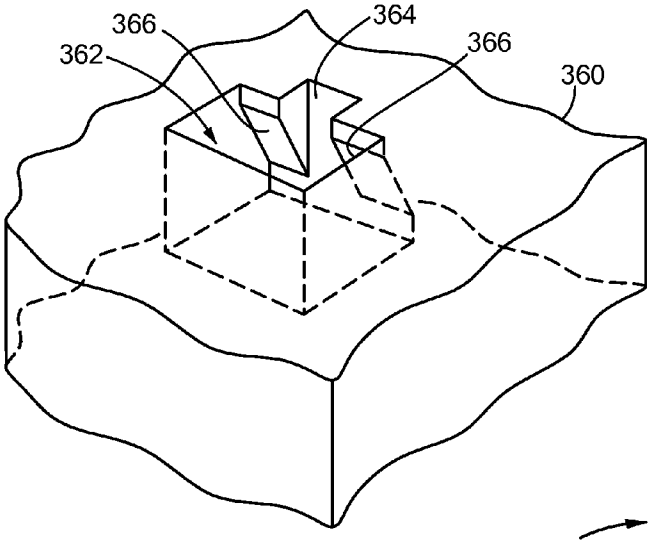
FIG. 17 is a perspective view of a stop comb in accordance with an embodiment of the present invention.

In another embodiment of the present invention, a stop comb 360, a portion of which is shown in FIG. 17, includes a comb opening 362 and a key opening 364. Ramp surfaces 366 are positioned adjacent the key opening 364 and are directed toward a surface of the stop comb 360.

Figure 18:
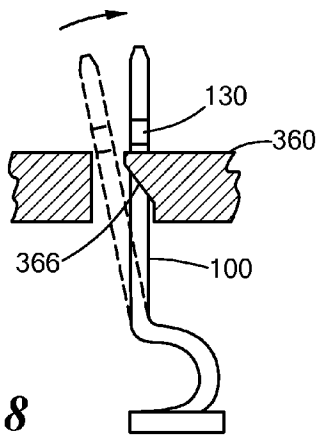
FIG. 18 is a side view of an implementation of the stop comb of FIG. 17.

In one approach, the stop comb 360 would be fixedly placed in a frame (not shown) such that the stop comb 360 does not move with respect to the frame. The stop comb 360 and frame are positioned and placed over one ore more pins 100 with a comb opening 362 corresponding to a respective pin 100. As shown in FIG. 18, as the stop comb 360 descends upon the pin 100, the pin 100 will be deflected (as shown by dotted lines) by the ramp surfaces 366 and then into the key opening 364 such that at least one of the wings 130 on the pin 100 engages with the stop comb 360.

Alternatively, the stop comb 360 may be movable with respect to the frame and the ramp surfaces 366 will similarly function to engage the pin 100 and move the wings 130 into position.

Figure 19:
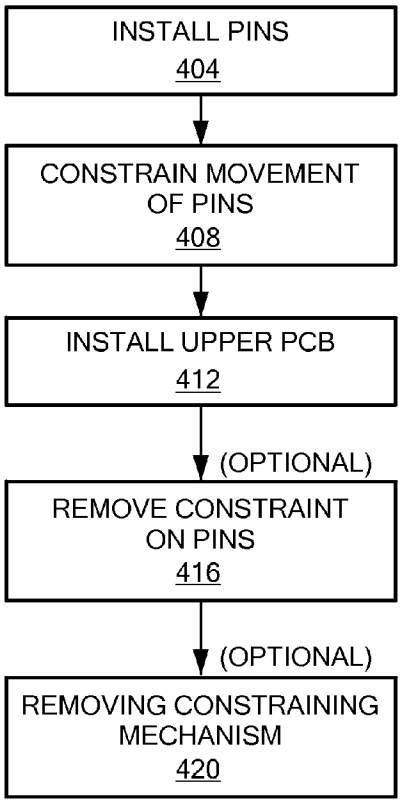
FIG. 19 is a flowchart of a method in accordance with an embodiment of the present invention.

Referring now to FIG. 19, a method in accordance with an embodiment of the present invention includes attaching the compliant pins to the first PCB, step 404, as described above, e.g., by surface mount soldering, and then constraining movement of the pins, step 408. As described above, this includes either placing a device within the flexible portion of the pin or limiting movement of another portion of the pin, e.g., constraining movement of the wings 130. The second, or upper, PCB is then placed on the compliant pins, step 412. Optionally, once the second PCB is placed, the constraint on the pins can be removed, step 416, and the constraining mechanism can optionally be removed, step 420.

It will be appreciated by those of ordinary skill in the art that modifications to and variations of the above-described apparatus and method of assembly may be made without departing from the inventive concepts disclosed herein. Accordingly, the invention should not be viewed as limited except by the scope and spirit of the appended claims.

What is claimed is:

1. A connection system, comprising:

a first substrate;

a plurality of compliant pins disposed in a first arrangement on the first substrate, each compliant pin comprising a first terminal end attached to the first substrate, a second terminal end and at least one wing extending therefrom, wherein the at least one wing is disposed between the first and second terminal ends;

a housing frame disposed on the first substrate; and a stop comb disposed in the housing frame, wherein the stop comb defines a plurality of comb openings provided in the same first arrangement as the plurality of attached compliant pins, wherein the housing frame is disposed on the first substrate such that the second terminal end of each attached compliant pin extends through a corresponding comb opening in the stop comb, and wherein a key opening portion of each comb opening is configured to capture at least one wing of the corresponding compliant pin to maintain the second terminal end at a fixed distance from the first substrate.

2. The connection system of claim 1, wherein each comb opening comprises a first portion and the key opening portion.

3. The connection system of claim 2, wherein the key opening portion has a width that is smaller than a width of the first portion.

4. The connection system of claim 2, wherein the stop comb is slidably disposed in the housing frame.

5. The connection system of claim 2, wherein the stop comb and housing frame are of a unitary construction.

6. The connection system of claim 2, wherein the first portion of each comb opening is sized to allow the at least one wing of the corresponding compliant pin to pass through.

7. The connection system of claim 6, wherein the key opening portion of each comb opening is sized to prevent the at least one wing of the corresponding compliant pin from passing through.

8. The connection system of claim 6, wherein the key opening portion of each comb opening comprises at least one ramp surface.

9. The connection system of claim 6, wherein the key opening portion is sized to catch at least one wing of a compliant pin disposed in the comb opening.

10. An inter-board connection system, comprising:

a housing frame; and a stop comb disposed in the housing frame, wherein the stop comb defines a plurality of comb openings, wherein each comb opening comprises a first portion and a key opening portion, wherein the first portion of each comb opening is sized to allow a corresponding compliant pin to pass through, and wherein the key opening portion of each comb opening comprises at least one ramp surface.

11. The inter-board connection system of claim 10, wherein the key opening portion has a width that is smaller than a width of the first portion.

12. The inter-board connection system of claim 10, wherein the stop comb is slidably disposed in the housing frame.

13. The inter-board connection system of claim 10, wherein the stop comb and housing frame are of a unitary construction.

14. The inter-board connection system of claim 10, wherein the key opening portion of each comb opening is sized to prevent the corresponding compliant pin from passing through.

15. The inter-board connection system of claim 10, wherein the key opening portion is sized to catch at least one wing of a compliant pin disposed in the comb opening.

16. A compliant terminal assembly for interconnecting first and second opposed circuit boards, the compliant terminal assembly comprising:

a movable stop member having a first predetermined dimension; and a compliant terminal comprising:

a first terminal end for electrical connection to the first circuit board;

a second terminal end for electrical connection to a second circuit board; and a compliant portion having opposed first and second members, the first member coupled to the first terminal end and the second member coupled to the second terminal end, the first and second members having a spacing therebetween slightly greater than the first predetermined dimension, wherein the stop member is movable from a first position located between the opposed first and second members of the compliant portion and a second position not located between the opposed first and second members of the compliant portion.

17. The connection system of claim 1, wherein the second terminal end comprises a press-fit solderless interconnect portion.

18. A connection system, comprising:

a first substrate;

a plurality of compliant pins disposed in a first arrangement on the first substrate, each compliant pin comprising at least one wing extending therefrom;

a housing frame disposed on the first substrate; and a stop comb disposed in the housing frame, wherein the stop comb defines a plurality of comb openings provided in the same first arrangement as the plurality of compliant pins, wherein the housing frame is disposed on the first substrate such that each comb opening corresponds to a compliant pin, wherein each comb opening is arranged and sized to capture at least one wing of the corresponding compliant pin, wherein each comb opening comprises a first portion and a key opening portion, and wherein the stop comb and housing frame are of a unitary construction.

19. The connection system of claim 18, wherein at least one compliant pin of the plurality of compliant pins comprises a press-fit solderless interconnect portion.

20. The connection system of claim 19, wherein the key opening portion of each comb opening comprises at least one ramp surface.

21. A connection system, comprising:

a first substrate;

a plurality of compliant pins disposed in a first arrangement on the first substrate, each compliant pin comprising at least one wing extending therefrom;

a housing frame disposed on the first substrate; and a stop comb disposed in the housing frame, wherein the stop comb defines a plurality of comb openings provided in the same first arrangement as the plurality of compliant pins, wherein the housing frame is disposed on the first substrate such that each comb opening corresponds to a compliant pin, wherein each comb opening is arranged and sized to capture at least one wing of the corresponding compliant pin, wherein each comb opening comprises a first portion and a key opening portion, wherein the first portion of each comb opening is sized to allow the corresponding compliant pin to pass through, and wherein the key opening portion of each comb opening comprises at least one ramp surface.

22. The connection system of claim 21, wherein the stop comb is slidably disposed in the housing frame.

23. The connection system of claim 21, wherein at least one compliant pin of the plurality of compliant pins comprises a press-fit solderless interconnect portion.

24. An inter-board connection system, comprising:

a housing frame; and a stop comb disposed in the housing frame, wherein the stop comb defines a plurality of comb openings, wherein each comb opening comprises a first portion and a key opening portion, and wherein the stop comb and housing frame are of a unitary construction.

25. The inter-board connection system of claim 24, wherein the key opening portion of each comb opening comprises at least one ramp surface.

* * * * *